US009222661B2

(12) United States Patent
Kim et al.

(10) Patent No.: US 9,222,661 B2
(45) Date of Patent: Dec. 29, 2015

(54) LIGHTING DEVICE

(71) Applicants: Jin Wook Kim, Seoul (KR); Jung Oh Chun, Seoul (KR); Sang Jun Hong, Seoul (KR); Ji Hwan Jeon, Seoul (KR)

(72) Inventors: Jin Wook Kim, Seoul (KR); Jung Oh Chun, Seoul (KR); Sang Jun Hong, Seoul (KR); Ji Hwan Jeon, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 135 days.

(21) Appl. No.: 13/760,348

(22) Filed: Feb. 6, 2013

(65) Prior Publication Data

US 2013/0271997 A1 Oct. 17, 2013

(30) Foreign Application Priority Data

Apr. 13, 2012 (KR) ..... 10-2012-0038787
Apr. 13, 2012 (KR) ..... 10-2012-0038788
Apr. 13, 2012 (KR) ..... 10-2012-0038823

(51) Int. Cl.

| | |
|---|---|
| ***F21V 29/00*** | (2015.01) |
| ***F21K 99/00*** | (2010.01) |
| ***F21V 7/18*** | (2006.01) |
| ***F21V 23/00*** | (2015.01) |
| *F21Y 101/02* | (2006.01) |

(52) U.S. Cl.

CPC . *F21V 29/22* (2013.01); *F21K 9/00* (2013.01); *F21V 7/18* (2013.01); *F21V 23/006* (2013.01); *F21V 29/004* (2013.01); *F21Y 2101/02* (2013.01)

(58) Field of Classification Search

CPC ..... F21V 15/01; F21V 29/22; F21V 29/20; F21S 8/02; F21K 9/30; F21Y 2101/02
USPC ..... 362/249.01, 249.02, 373, 294, 296.01
See application file for complete search history.

(56) References Cited

U.S. PATENT DOCUMENTS

| | | | | |
|---|---|---|---|---|
| 2006/0227558 | A1 | 10/2006 | Osawa et al. | 362/351 |
| 2009/0213595 | A1 | 8/2009 | Alexander et al. | 362/373 |
| 2010/0046224 | A1* | 2/2010 | Lin | 362/249.02 |
| 2010/0124058 | A1* | 5/2010 | Miller | 362/249.02 |
| 2011/0157901 | A1* | 6/2011 | Chen | 362/373 |
| 2012/0026740 | A1 | 2/2012 | Kim et al. | 362/294 |
| 2012/0140442 | A1* | 6/2012 | Woo et al. | 362/95 |

FOREIGN PATENT DOCUMENTS

| | | | |
|---|---|---|---|
| EP | 2 461 094 | A2 | 6/2012 |
| WO | WO 2011/083939 | A2 | 7/2011 |
| WO | WO 2011/141846 | A2 | 11/2011 |

OTHER PUBLICATIONS

European Search Report dated Jul. 19, 2013 issued in Application No. 13 15 2291.

* cited by examiner

*Primary Examiner* — Julie Bannan
(74) *Attorney, Agent, or Firm* — Ked & Associates, LLP

(57) ABSTRACT

A lighting device may be provided that includes: a heat sink which includes a base and a projection extending from the base and having one side; a light source which includes a substrate disposed on the one side of the projection and a light emitting device disposed on the substrate; an optical plate disposed on the light emitting device; a driving part which is disposed on the base and is electrically connected to the light source; and a housing which receives the heat sink, the light source, the optical plate and the driving part, wherein the one side of the projection is disposed between a first point and a second point, wherein the first point indicates a half of the overall height of the housing, and wherein the second point indicates a minimum interval of 5 mm between the light emitting device and the optical plate.

19 Claims, 5 Drawing Sheets

LIGHTING DEVICE

CROSS-REFERENCE TO RELATED APPLICATION

The present application claims priority under 35 U.S.C. §119(e) of Korean Patent Application No. 10-2012-0038787 filed Apr. 13, 2012, No. 10-2012-0038788 filed Apr. 13, 2012 and No. 10-2012-0038823 filed Apr. 13, 2012 the subject matters of which are incorporated herein by reference.

BACKGROUND

1. Field

Embodiments may relate to a lighting device.

2. Background

A light emitting diode (LED) is an energy device for converting electric energy into light energy. Compared with an electric bulb, the LED has higher conversion efficiency, lower power consumption and a longer life span. As there advantages are widely known, more and more attentions are now paid to a lighting apparatus using the LED.

The lighting apparatus using the LED are generally classified into a direct lighting apparatus and an indirect lighting apparatus. The direct lighting apparatus emits light emitted from the LED without changing the path of the light. The indirect lighting apparatus emits light emitted from the LED by changing the path of the light through reflecting means and so on. Compared with the direct lighting apparatus, the indirect lighting apparatus mitigates to some degree the intensified light emitted from the LED and protects the eyes of users.

SUMMARY

One embodiment is a lighting device. The lighting device includes: a heat sink which includes a base and a projection extending from the base and having one side; a light source which includes a substrate disposed on the one side of the projection and a light emitting device disposed on the substrate; an optical plate disposed on the light emitting device; a driving part which is disposed on the base and is electrically connected to the light source; and a housing which receives the heat sink, the light source, the optical plate and the driving part. The one side of the projection is disposed between a first point and a second point. The first point indicates a half of the overall height of the housing. The second point indicates a minimum interval of 5 mm between the light emitting device and the optical plate.

Another embodiment is a lighting device. The lighting device includes: a heat sink which includes a base and a projection, wherein the base includes a first surface and wherein the projection extends from the first surface of the base and includes a second surface; a light source which includes a substrate disposed on the second surface of the projection and a light emitting device disposed on the substrate; and a driving part which is disposed on the first surface of the base and is electrically connected to the light source. A second straight line passing through the center of the second surface of the projection is ⅓ to ½ as much as a first straight line passing through the center of the first surface of the base.

Further another embodiment is a lighting device. The lighting device includes: a heat sink; a light source disposed on the heat sink; a reflector which is disposed on the light source and includes a reflective surface reflecting light emitted from the light source; and a reflective sheet disposed on the reflective surface of the reflector. The reflective sheet includes: a base sheet having one end in which at least one incision is formed; and a connecting sheet which is disposed on the other end of the base sheet and is coupled to the incision.

BRIEF DESCRIPTION OF THE DRAWINGS

Arrangements and embodiments may be described in detail with reference to the following drawings in which like reference numerals refer to like elements and wherein.

DETAILED DESCRIPTION

A thickness or a size of each layer may be magnified, omitted or schematically shown for the purpose of convenience and clearness of description. The size of each component may not necessarily mean its actual size.

It should be understood that when an element is referred to as being 'on' or "under" another element, it may be directly on/under the element, and/or one or more intervening elements may also be present. When an element is referred to as being 'on' or 'under', 'under the element' as well as 'on the element' may be included based on the element.

An embodiment may be described in detail with reference to the accompanying drawings.

Figure 1:
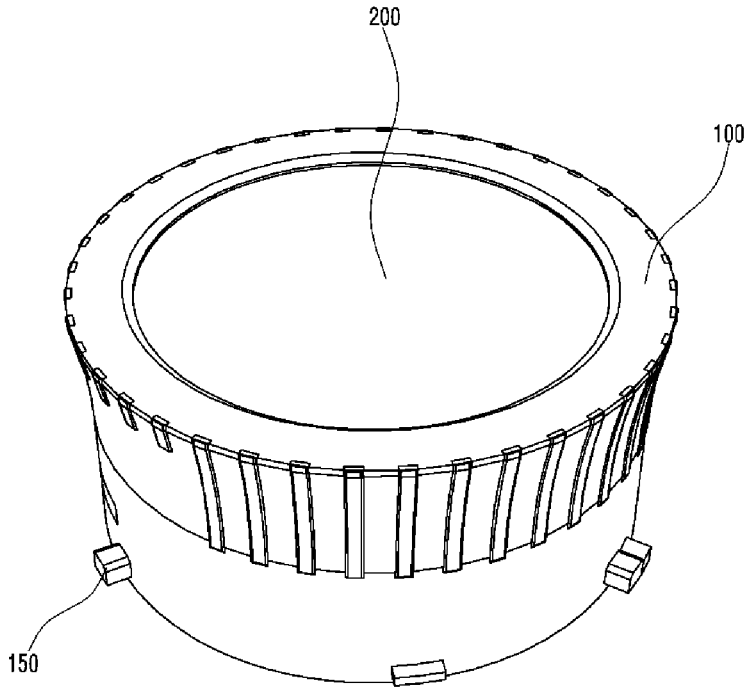
FIG. 1 is a top perspective view of a lighting device according to an embodiment.
Figure 2:
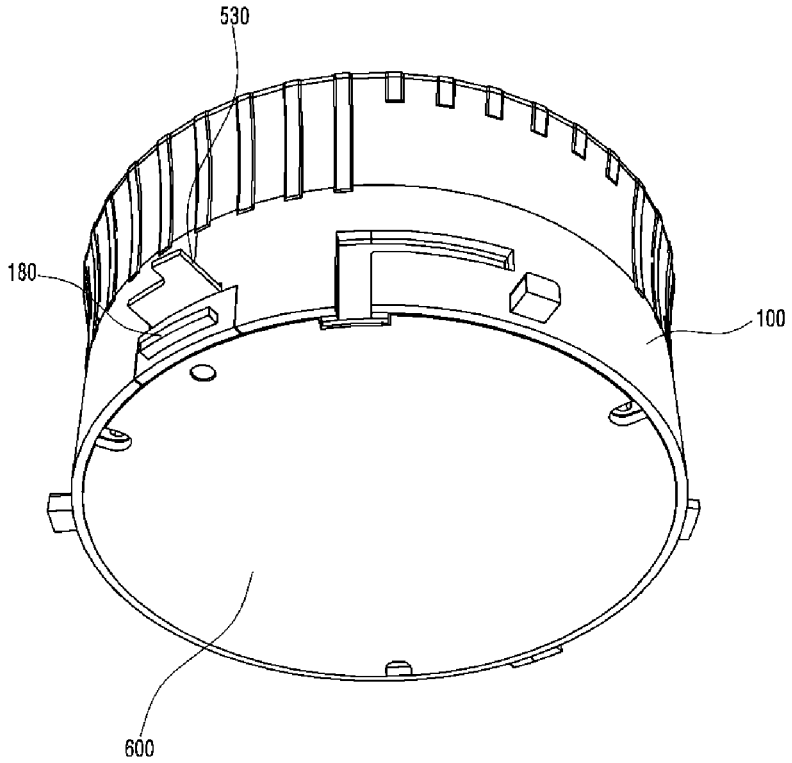
FIG. 2 is a bottom perspective view of the lighting device shown in FIG. 1.
Figure 3:
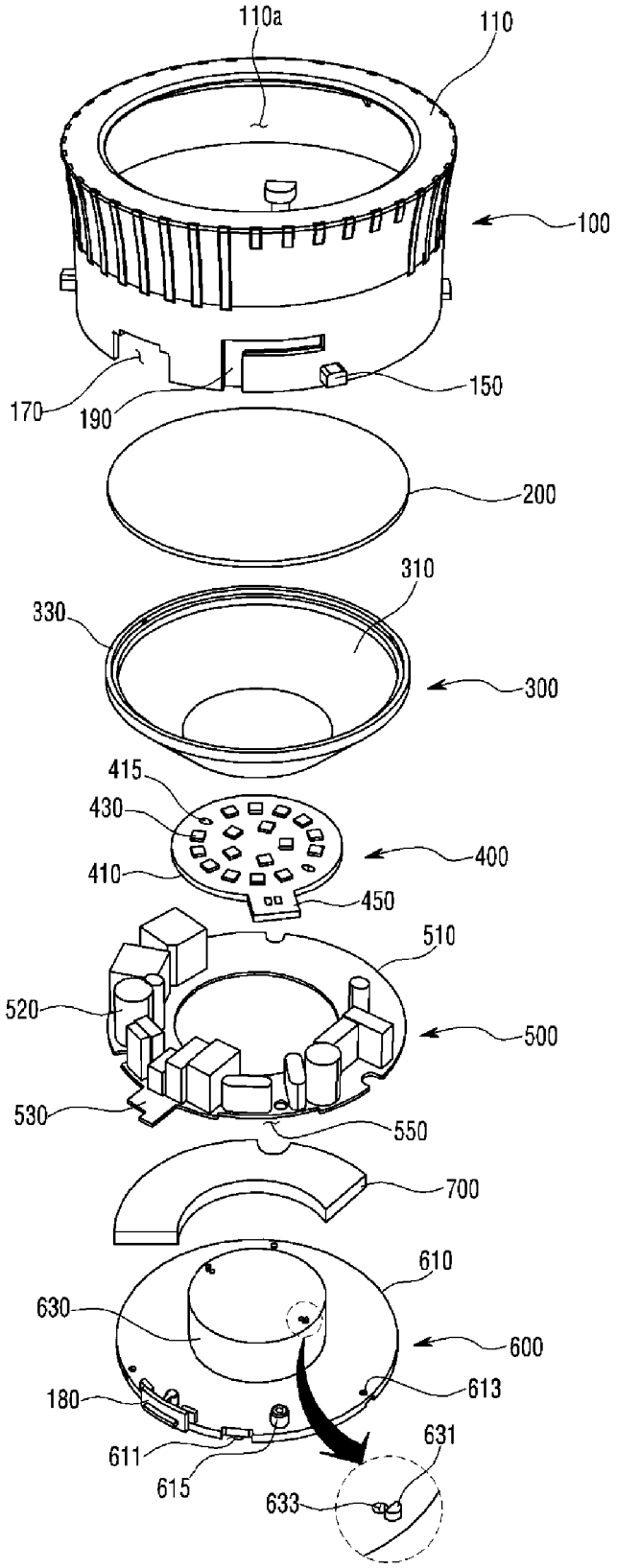
FIG. 3 is an exploded perspective view of the lighting device shown in FIG. 1.
Figure 4:
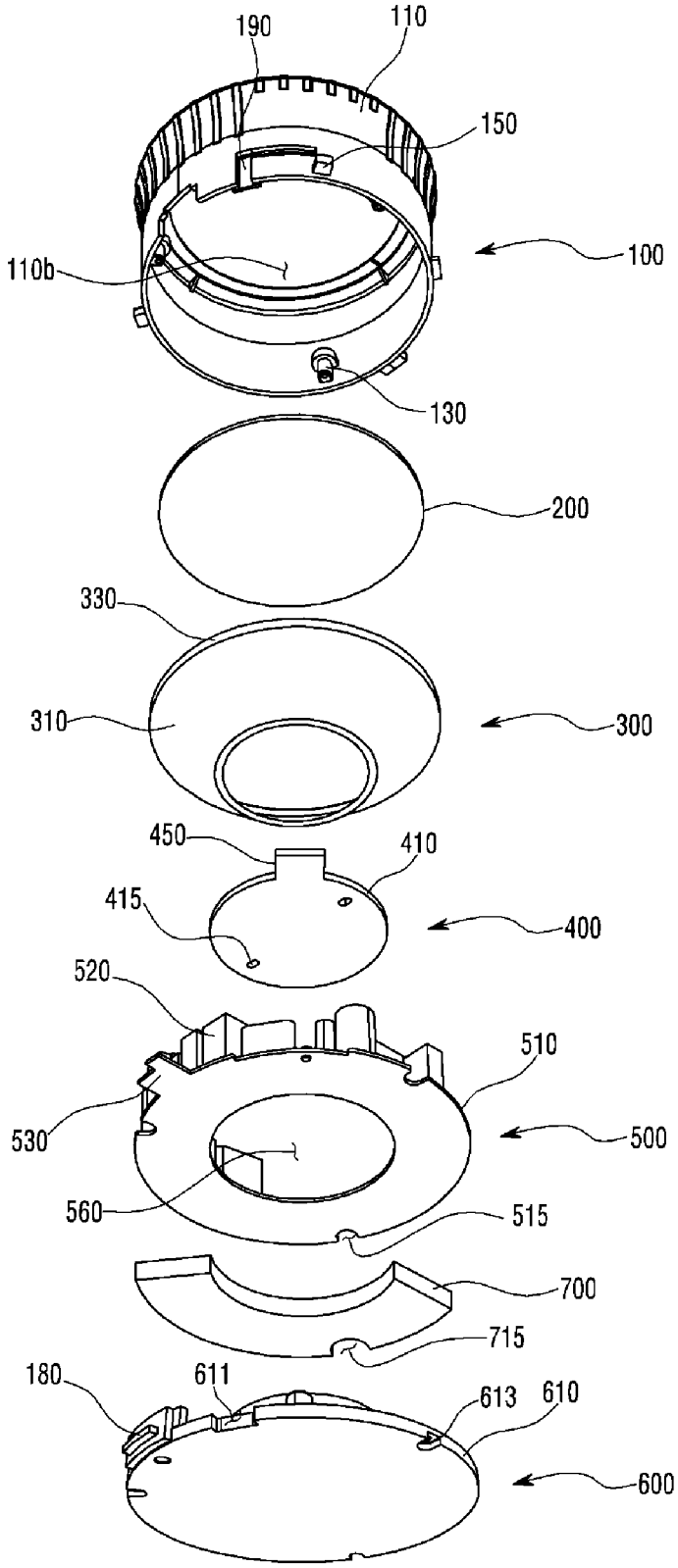
FIG. 4 is an exploded perspective view of the lighting device shown in FIG. 2.
Figure 5:
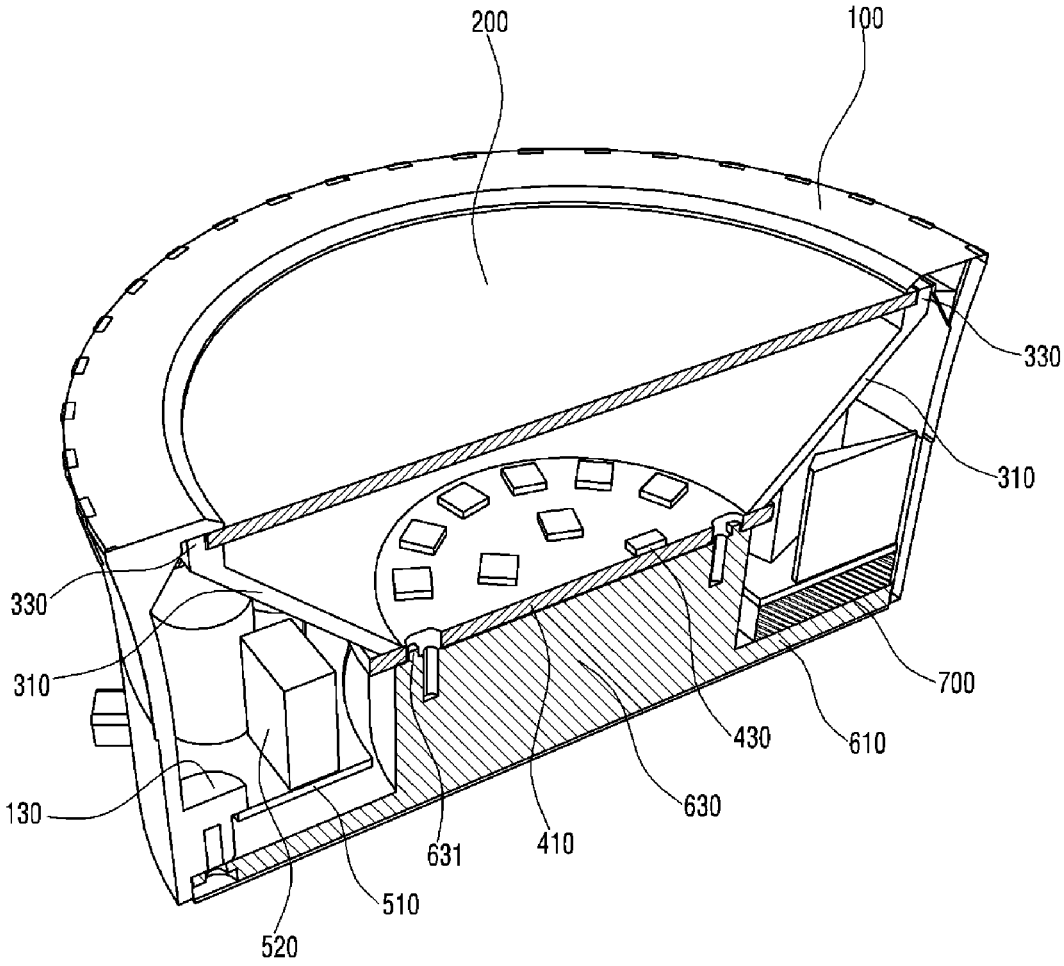
FIG. 5 is a sectional perspective view of the lighting device shown in FIG. 1.
Figure 6:
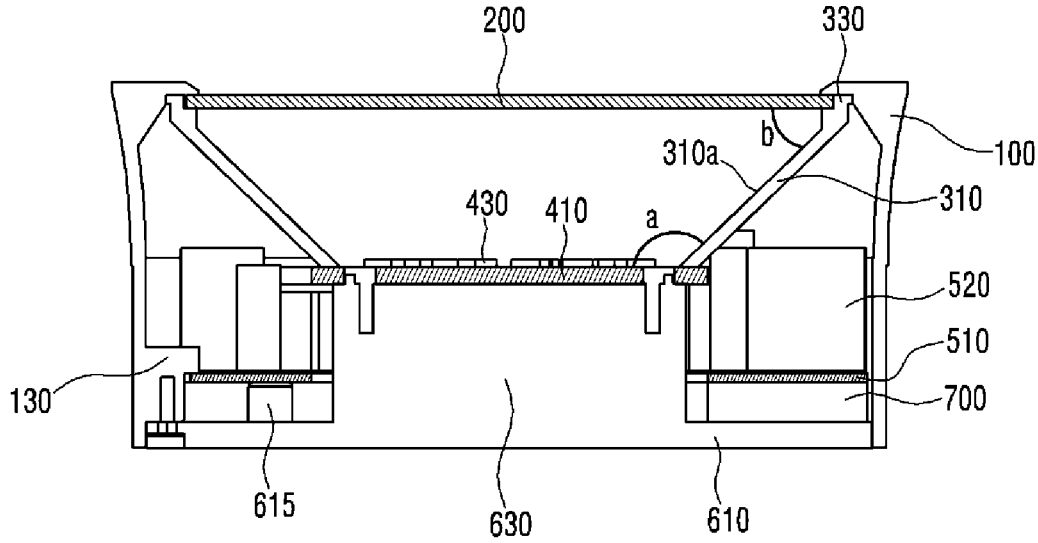
FIG. 6 is a cross sectional view of the lighting device shown in FIG. 1.

FIG. 1 is a top perspective view of a lighting device according to an embodiment. FIG. 2 is a bottom perspective view of the lighting device shown in FIG. 1. FIG. 3 is an exploded perspective view of the lighting device shown in FIG. 1. FIG. 4 is an exploded perspective view of the lighting device shown in FIG. 2. FIG. 5 is a sectional perspective view of the lighting device shown in FIG. 1. FIG. 6 is a cross sectional view of the lighting device shown in FIG. 1.

Referring to FIGS. 1 to 6, the lighting device according to the embodiment may include a housing 100, an optical plate 200, a reflector 300, a light source 400, a driving part 500 and a heat sink 600.

<Housing 100>

The housing 100 may receive the optical plate 200, the reflector 300, the light source 400, the driving part 500 and the heat sink 600. The housing 100, together with the heat sink 600, may form an appearance of the lighting device according to the embodiment.

The housing 100 may have a cylindrical shape. However, the housing 100 may have a polygonal box shape, without being limited to this.

The housing 100 may have a cylindrical shape with an empty interior in order to receive the optical plate 200, the reflector 300, the light source 400, the driving part 500 and the heat sink 600.

The top and bottom surfaces of the housing 100 are in an open state. Therefore, the housing 100 may have two openings. Hereafter, for convenience of description, the two openings are designated as a top opening 110*a* and a bottom opening 110*b* respectively.

The optical plate 200, the reflector 300, the light source 400, the driving part 500 and the heat sink 600 may be received in the order listed toward the top opening 110*a* through the bottom opening 110*b* of the housing 100. Here, a diameter of the top opening 110*a* may be designed to be less than that of the bottom opening 110*b*.

The optical plate 200 may be disposed in the top opening 110*a* of the housing 100. Specifically, the diameter of the top opening 110*a* is designed to be less than that of the optical plate 200, so that the optical plate 200 is disposed in the top opening 110*a* of the housing 100 without passing through the top opening 110*a* of the housing 100.

The heat sink 600 is disposed in the bottom opening 110*b* of the housing 100. Specifically, a base 610 of the heat sink 600 may be disposed in the bottom opening 110*b* of the housing 100.

The housing 100 may include a fastener 130. The fastener 130 may be disposed in a lower portion of the inner surface of the housing 100. The fastener 130 may project outwardly from the inner surface of the housing 100. A screw may be inserted and fixed to the fastener 130. The screw may be coupled to the fastener 130 by passing through a fastening hole 613 of the heat sink 600.

Also, as shown in FIGS. 5 and 6, the fastener 130 may function as a means for fixing the driving part 500 to the inside of the housing 100. Specifically, the fastener 130 is disposed on a circuit board 510 of the driving part 500 and limits the movement of the circuit board 510 by pressing down the circuit board 510. The fastener 130, together with a support 615 of the heat sink 600 and a thermal pad 700, is able to block the movement of the circuit board 510. That is, the support 615 and the thermal pad 700 are disposed under the circuit board 510, and the fasteners 130 are disposed on the circuit board 510, so that the movement of the circuit board 510 can be blocked.

The housing 100 may include a projection 150. The projection 150 projects outwardly from the outer surface of the housing 100. A plurality of the projections 150 may be provided. The projection 150 may fix the lighting device according to the embodiment to a particular point, for example, a ceiling and the like.

The housing 100 may include a recess 170. A protruding plate 530 of the driving part 500 and an auxiliary stopper 180 may be disposed in the recess 170.

The housing 100 may include the auxiliary stopper 180. The auxiliary stopper 180 is inserted into the recess 170 of the housing 100. The auxiliary stopper 180, together with the protruding plate 530 of the driving part 500, is able to stop the recess 170.

The housing 100 may include a key 190. When the driving part 500 and the heat sink 600 are disposed in the bottom opening 110*b* of the housing 100, the key 190 may perform a function of indicating a direction in which the driving part 500 and the heat sink 600 are coupled to each other and where the driving part 500 and the heat sink 600 are coupled to each other. The key 190 may have a shape dug from the outer surface to the inner surface of the housing 100. The key 190 may also have a shape projecting from the inner surface of the housing 100 to the inside of the housing 100. The key 190 may be inserted into a key recess 550 of the driving part 500 and inserted into a key recess 611 of the heat sink 600.

In the key 190, a portion of the key 190, which is coupled to the key recess 550 of the driving part 500, may have a shape different from that of a portion of the key 190, which is coupled to the key recess 611 of the heat sink 600. Specifically, the key 190 may include a first key and a second key. The first key is inserted into the key recess 550 of the driving part 500. The second key is inserted into the key recess 611 of the heat sink 600. The first key may have a volume greater than that of the second key. Therefore, the key recess 550 of the driving part 500, which is inserted into the first key, may be larger than the key recess 611 of the heat sink 600, which is inserted into the second key. As such, when the first and the second key have mutually different shapes, it is possible to easily identify a direction in which the driving part 500 and the heat sink 600 are coupled to each other and where the driving part 500 and the heat sink 600 are coupled to each other. Accordingly, the lighting device according to the embodiment can be easily assembled.

<Optical Plate 200>

The optical plate 200 is disposed within the housing 100. Specifically, the optical plate 200 may be disposed in the top opening 110*a* of the housing 100.

When the housing 100 is coupled to the heat sink 600, the optical plate 200 is inserted and fixed between the housing 100 and the reflector 300. Therefore, the optical plate 200 may be disposed in the top opening 110*a* of the housing 100 without a separate coupling means. This is because the diameter of the optical plate 200 is larger than that of the top opening 110*a* of the housing 100.

An opalescent pigment may be coated on the outer or inner surface of the optical plate 200. The pigment may include a diffusing agent which diffuses light passing through the optical plate 200.

The optical plate 200 may be formed of glass. However, the glass is vulnerable to weight or external impact. Therefore, the optical plate 200 may be formed of plastic, polypropylene (PP), polyethylene (PE) and the like. Preferably, the optical plate 200 may be formed of polycarbonate (PC) which is used to diffuse light and has excellent light resistance, thermal resistance and impact strength.

The roughness of the inner surface of the optical plate 200 may be larger than that of the outer surface of the optical plate 200. In this case, it is possible to sufficiently scatter and diffuse light emitted from the light source 400.

The optical plate 200 is able to excite the light emitted from the light source 400. The optical plate 200 may have a fluorescent material in order to excite the light emitted from the light source 400. The fluorescent material may include at least any one selected from a group consisting of a garnet material (YAG, TAG), a silicate material, a nitride material and an oxynitride material. The optical plate 200 is able to convert the light emitted from the light source 400 into natural light (white light) by including a yellow fluorescent material. However, the optical plate 200 may further include a green fluorescent material or a red fluorescent material in order to improve a color rendering index and to reduce a color temperature. Here, an addition ratio of the color of the fluorescent material may be formed such that the green fluorescent material is more used than the red fluorescent material, and the yellow fluorescent material is more used than the green fluorescent material. The garnet material, the silicate material and the oxynitride material may be used as the yellow fluorescent material. The silicate material and the oxynitride material may be used as the green fluorescent material. The nitride material may be used as the red fluorescent material.

<Reflector 300>

The reflector 300 is disposed within the housing 100. Specifically, the reflector 300 may be received in the interior space of the housing 100 through the bottom opening 110*b* of the housing 100.

The reflector 300 is disposed on the light source 400. Specifically, the reflector 300 may be disposed on a substrate 410 of the light source 400 and may be disposed to surround the light emitting devices 430.

The reflector 300 may be fixed to the inside of the housing 100 by being pressed between the optical plate 200 and the substrate 410.

Thanks to the coupling of the housing 100 and the heat sink 600, the reflector 300 may support the optical plate 200 and fix the optical plate 200 to the top opening 110*a* of the housing 100.

The reflector 300 may include a reflecting portion 310 and a guide 330.

The reflecting portion 310 reflects light emitted from the light source 400 to the optical plate 200.

The reflecting portion 310 may have a cylindrical shape of which the diameter increases toward the optical plate 20 from the substrate 410. The lower portion of the reflector 310 is disposed on the substrate 410. The optical plate 200 is disposed on the upper portion of the reflecting portion 310.

The reflecting portion 310 includes one reflective surface 310*a* forming a predetermined angle "a" with the top surface of the substrate 410. The predetermined angle "a" may be an obtuse angle.

The optical plate 200 is disposed on the reflecting portion 310. The reflective surface 310*a* of the reflecting portion 310 may form an acute angle "b" with the inner surface of the optical plate 200.

The guide 330 is disposed on the upper portion of the reflecting portion 310. The guide 330 may project upward from the upper portion of the reflecting portion 310. The guide 330 may limit the movement of the optical plate 200 by guiding the outer circumference of the optical plate 200.

A reflective sheet (not shown) may be disposed on the reflecting portion 310 of the reflector 300. Hereafter, the reflective sheet (not shown) will be described in detail with reference to the drawings.

<Reflective Sheet 3000>

The lighting device according to the embodiment may further include a reflective sheet. For this purpose, this will be described in detail with reference to FIGS. 7 to 8.

Figure 7:
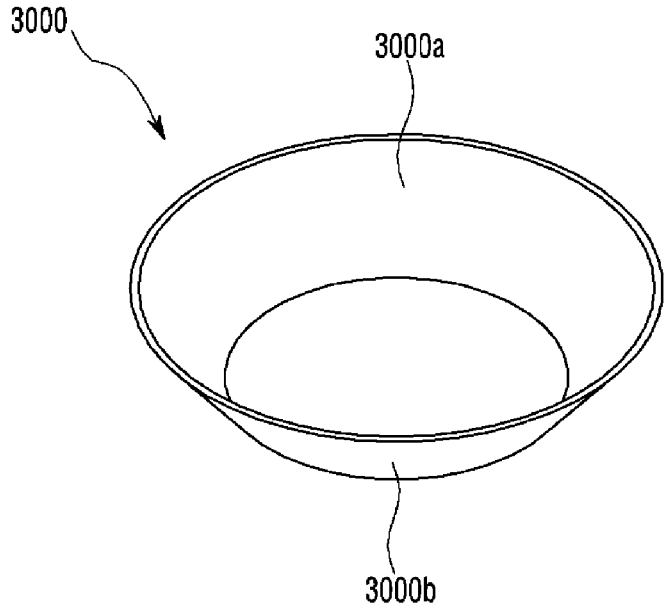
FIG. 7 is a dimensional view of a reflective sheet.

FIG. 7 is a dimensional view of a reflective sheet 3000.

Referring to FIG. 7, the reflective sheet 3000 may be disposed on the reflective surface 310*a* of the reflector 300, which is shown in FIGS. 1 to 6. Specifically, the reflective sheet 3000 may be disposed contacting with the reflective surface 310*a*.

The reflective sheet 3000 may have a shape corresponding to the reflective surface 310*a*. However, there is no limit to the shape of the reflective sheet 3000. The reflective sheet 3000 may have a shape different from that of the reflective surface 310*a*.

Specifically, the reflective sheet 3000 may have an inner surface 3000*a* and an outer surface 3000*b*.

The inner surface 3000*a* may be made of a material capable of reflecting the light emitted from the light source 400. The outer surface 3000*b* comes in surface contact with the reflective surface 310*a*. Here, the outer surface 3000*b* may be coated with an adhesive material for the purpose of being adhered to the reflective surface 310*a*.

Figure 8:
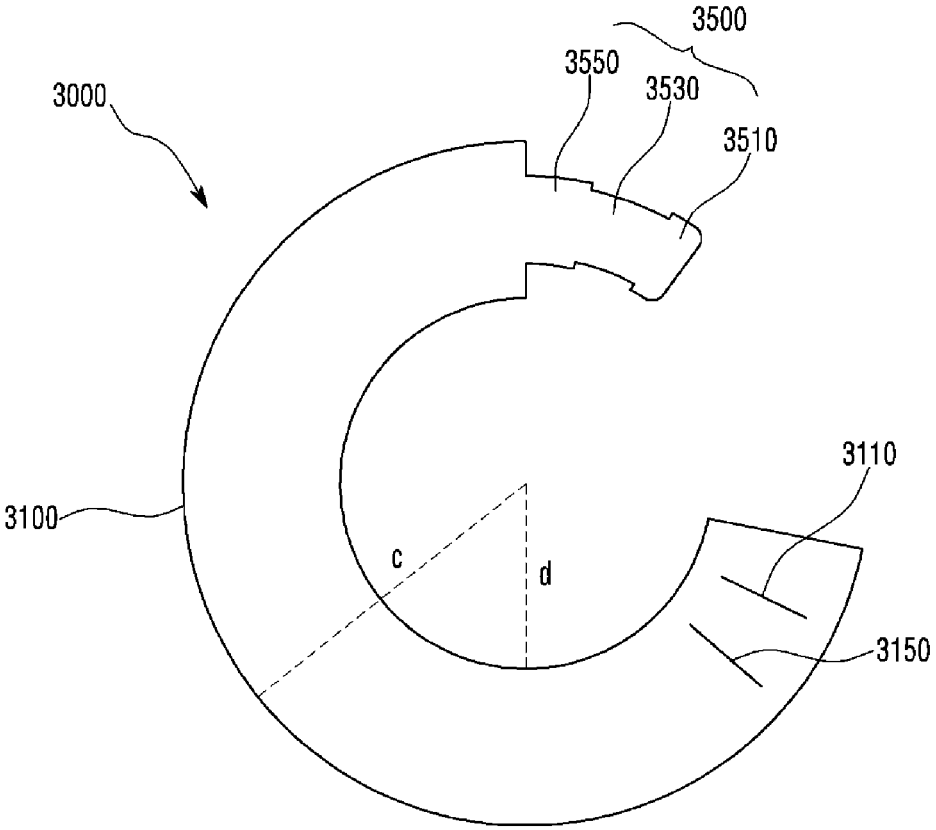
FIG. 8 is a development figure of the reflective sheet shown in FIG. 7.

FIG. 8 is a development figure of the reflective sheet 3000 shown in FIG. 7. Here, the development figure of the reflective sheet 3000 shown in FIG. 8 may be an example of the reflective sheet 3000 shown in FIG. 7.

Referring to FIG. 8, the reflective sheet 3000 may include a base sheet 3100 and a connecting sheet 3500.

The base sheet 3100 may have a circular shape having a radius of "c". The circular sheet has a circular opening having a radius of "d". The circular opening is formed at the center of the base sheet 3100. Here, the base sheet 3100 is not limited to the circular sheet. The base sheet 3100 may be one-straight sheet.

Specifically, the base sheet 3100 may have a belt shape. The belt-shaped base sheet 3100 may have a shape of which a portion has been removed. Therefore, the belt-shaped base sheet 3100 has one end and the other end.

Any one of both ends of the base sheet 3100 may have one or more incisions 3110 and 3150. The connecting sheet 3500 is disposed on the other end of the base sheet 3100 and may be coupled to the incisions 3110 and 3150.

Specifically, the base sheet 3100 includes at least two incisions, i.e., a first incision 3110 and a second incision 3150. Specifically, the first and the second incisions 3110 and 3150 are disposed on one end of the base sheet 3100. Incision lengths of the first and the second incisions 3110 and 3150 may be the same as the width of a second connecting portion 3530 of the connecting sheet 3500 and may be less than the widths of a first and a third connecting portions 3510 and 3550. The connecting sheet 3500 may be inserted into the first and the second incisions 3110 and 3150.

The connecting sheet 3500 may extend from the other end of the base sheet 3100 toward one end of the base sheet 3100. The connecting sheet 3500 may be coupled to the first and the second incisions 3110 and 3150 of the base sheet 3100.

Specifically, the connecting sheet 3500 may include the first connecting portion 3510, the second connecting portion 3530 and the third connecting portion 3550. The third connecting portion 3550 is connected to the other end of the base sheet 3100. The second connecting portion 3530 is connected to the third connecting portion 3550. The first connecting portion 3510 is connected to the second connecting portion 3530.

While the first connecting portion 3510 may have the same width as that of the third connecting portion 3550, the width of the second connecting portion 3530 may be less than those of the first and the third connecting portions 3510 and 3550. Also, the widths of the first and the third connecting portions 3510 and 3550 may be greater than the incision lengths of the first and the second incisions 3110 and 3150. When the widths of the first and the third connecting portions 3510 and 3550 are greater than the incision lengths of the first and the second incisions 3110 and 3150, the movement of the connecting sheet 3500 inserted into the first and the second incisions 3110 and 3150 may be limited.

The first connecting portion 3510 enters the first incision 3110 from the rear of the base sheet 3100 and passes through the first incision 3110 and the second incision 3150 in the order listed, and then may be disposed on the rear of the base sheet 3100. The second connecting portion 3530 passes through the first incision 3110 along the first connecting portion 3510, and then may be disposed on the front of the base sheet 3100. The third connecting portion 3550 moves along the second connecting portion 3530, and then may be disposed on the rear of the base sheet 3100.

In the reflective sheet 3000 shown in FIG. 8, since the width of the second connecting portion 3530 is less than those of the first and the third connecting portions 3510 and 3550 and the incision lengths of the first and the second incisions 3110 and 3150 are the same as the width of the second connecting portion 3530, the connecting sheet 3500 and the base sheet 3100, which have been coupled to each other, are difficult to separate from each other and are able to maintain a shape as it is, which is formed through the coupling of themselves even though they are formed in a sheet form.

After the reflective sheet 3000 shown in FIGS. 7 and 8 is simply assembled, the reflective sheet 3000 can be easily installed on the reflector 300. Since there is no need to form the reflector 300 by using a reflective material, it is possible to accomplish the manufacturing cost reduction.

<Light Source 400>

The light source 400 includes the light emitting device 430 which emits light.

The light source 400 is disposed within the housing 100 and on the heat sink 600. Specifically, the light source 400 is disposed on a projection 630 of the heat sink 600.

The light source 400 may include the substrate 410 and the light emitting device 430 disposed on the substrate 410.

The substrate 410 has a circular plate shape. However, the substrate 410 may have various shapes without being limited to this. For example, the substrate 410 may have a polygonal plate shape. The substrate 410 is formed by printing a circuit pattern on an insulator. For example, the substrate 410 may include a common printed circuit board (PCB), a metal core PCB, a flexible PCB, a ceramic PCB and the like. Also, the substrate 410 may include a chips on board (COB) allowing an unpackaged LED chip to be directly bonded to a printed circuit board. The substrate 410 may be formed of a material capable of efficiently reflecting light. The surface of the substrate 410 may have a color such as white, silver and the like capable of efficiently reflecting light.

The substrate 410 is disposed between the heat sink 600 and the reflector 300. Specifically, the substrate 410 is disposed on the projection 630 of the heat sink 600. The reflector 300 is disposed on the substrate 410.

The substrate 410 is disposed on the driving part 500 in such a manner as to be physically separated from the driving part 500. That is, the substrate 410 and the driving part 500 are spatially separated from each other. In this manner, when the light source 400 and the driving part 500 are physically or spatially separated from each other, there are advantages that heat from the driving part 500 is not directly transferred to the light source 400 and heat from the light source 400 is not directly transferred to the driving part 500, so that circuit components of the driving part 500 can be protected. Also, since the light source 400 and the driving part 500 are disposed independently of each other, they can be easily maintained and repaired.

The substrate 410 may include a hole 415. A key 631 of the heat sink 600 is inserted into and coupled to the hole 415. Thanks to the coupling of the hole 415 and the key 631, it is possible to easily identify a direction in which the substrate 410 is coupled to the heat sink 600 and where the substrate 410 is coupled to the heat sink 600. Further, a screw may be inserted into the hole 415. The screw may be coupled to a fastening hole 633 of the heat sink 600 by being inserted into the hole 415. Through this, the substrate 410 can be coupled to the heat sink 600. The hole 415 of the substrate 410 may be larger than the fastening hole 633 of the heat sink 600 in order that the screw and the key 631 of the heat sink 600 are inserted together into the hole 415.

The substrate 410 may include a connection board 450 allowing the substrate 410 to be electrically connected to the circuit board 510 of the driving part 500. The connection board 450 may extend outwardly from one side of the substrate 410.

The connection board 450 and the circuit board 510 may be connected to each other by means of a wire. Also, the connection board 450 and the circuit board 510 may be electrically connected to each other by using a separate independently configured connector (not shown) instead of the wire.

A plurality of the light emitting devices 430 are disposed on one side of the substrate 410.

The light emitting device 430 may be a light emitting diode chip emitting red, green and blue light or a light emitting diode chip emitting UV. Here, the light emitting diode may have a lateral type or vertical type and may emit blue, red, yellow or green light.

The light emitting device 430 may have a fluorescent material. When the light emitting diode is a blue light emitting diode, the fluorescent material may include at least any one selected from the group consisting of a garnet material (YAG, TAG), a silicate material, a nitride material and an oxynitride material.

<Driving Part 500>

The driving part 500 receives electric power from the outside thereof and converts the electric power in conformity with the light source 400. Then, the driving part 500 supplies the converted electric power to the light source 400.

The driving part 500 is disposed within the housing 100 and disposed on the base 610 of the heat sink 600.

The driving part 500 may include the circuit board 510 and a plurality of parts 520 mounted on the circuit board 510. The plurality of the parts 520 may include, for example, a DC converter converting AC power supply supplied by an external power supply into DC power supply, a driving chip controlling the driving of the light source 400, and an electrostatic discharge (ESD) protective device for protecting the light source 400.

Though the circuit board 510 has a circular plate shape, the circuit board 510 may have various shapes without being limited to this. For example, the circuit board 510 may have an elliptical or polygonal plate shape. The circuit board 510 may be formed by printing a circuit pattern on an insulator.

The circuit board 510 is disposed between the support 615 of the heat sink 600 and the fastener 130 of the housing 100, and then may be fixed within the housing 100. Otherwise, the circuit board 510 is disposed between the thermal pad 700 and the fastener 130 of the housing 100, and then may be fixed within the housing 100. If the thermal pad 700 is disposed only on a portion of the heat sink 600, the circuit board 510 may be fixed within the housing 100 by the support 615 of the heat sink 600, the thermal pad 700 and the fastener 130 of the housing 100.

The circuit board 510 may include the projecting plate 530. The projecting plate 530 may project or extend outwardly from the circuit board 510. Unlike the circuit board 510, the projecting plate 530 is disposed outside the housing 100 and receives electric power from the outside.

The projecting plate 530 may be inserted into the recess 170 of the housing 100 and fixed to the housing 100 by means of the auxiliary stopper 180.

The circuit board 510 may include the key groove 550. The key 190 of the housing 100 is inserted into the key groove 550. The key groove 550 indicates a direction in which the circuit board 510 is coupled to the housing 100 and where the circuit board 510 is coupled to the housing 100.

The circuit board 510 may include an insertion hole 560. The insertion hole 560 may be disposed at the center of the circuit board 510. The projection 630 of the heat sink 600 is inserted into the insertion hole 560. The projection 630 of the heat sink 600 is disposed to pass through the insertion hole 560, so that the light source 400 and the driving part 500 may be spatially or physically separated from each other.

The circuit board 510 may include a recess 515. The fastener 130 of the housing 100 may be inserted into the recess 515. When the fastener 130 is inserted into the recess 515, it is possible to prevent the circuit board 510 from moving and to identify the arrangement direction or position of the circuit board 510.

<Heat Sink 600>

The heat sink 600 is coupled to the housing 100. Specifically, the heat sink 600 may be disposed in the bottom opening 110*b*.

The heat sink 600 radiates heat from the light source 400 and the driving part 500.

Specifically, the heat sink 600 may include the base 610 and the projection 630.

The base 610 may have a circular plate shape having a predetermined depth and may have a first surface on which the circuit board 510 is disposed. The projection 630 may project or extend upwardly from the central portion of the base 610 and may have a second surface on which the substrate 410 is disposed. Here, there is a predetermined level difference between the first surface and the second surface. The second surface is placed on the first surface. Due to the level difference between the first surface and the second surface, the substrate 410 and the circuit board 510 may be spatially separated from each other.

A first straight line passing through the center of the first surface of the base 610 may have a predetermined relationship with a second straight line passing through the center of the second surface of the projection 630. Hereafter, this will be described in detail. Here, it is assumed that the first straight line is located on the first surface and the second straight line is located on the second surface of the projection 630.

The second straight line of the projection 630 may be ⅓ to ½ as much as the first straight line of the base 610. When the second straight line is ⅓ to ½ as much as the first straight line, heat radiation performance is more improved and a space more appropriate for receiving the driving part 500 can be obtained than those in a case where the second straight line is within a range other than the aforementioned range of ⅓ to ½ as much as the first straight line. Specifically, when the second straight line is less than ⅓ of the first straight line, the heat generated from the light source 400 cannot be efficiently transferred to the base 610 through the projection 630. When the second straight line is greater than ½ of the first straight line, the space for receiving the driving part 500 becomes smaller.

The circuit board 510 of the driving part 500 is disposed on the base 610, and the substrate 410 of the light source 400 is disposed on the projection 630. The projection 630 passes through the insertion hole 560 of the circuit board 510. The base 610 and the projection 630 cause the light source 400 and the driving part 500 to be physically or spatially separated from each other. Also, the light source 400 may be disposed on the driving part 500 within the housing 100 by the base 610 and the projection 630.

The projection 630 may be integrally formed with the base 610. That is, the projection 630 and the base 610 may be integrally formed with each other by using a diecasting method. Moreover, the projection 630 and the base 610 may be formed independently of each other, and then coupled to each other.

The base 610 may include the key recess 611. The key recess 611 may have a shape dug from the outer circumference of the base 610 toward the projection 630. The key 190 of the housing 190 is inserted into the key recess 611. Thanks to the key recess 611, it is possible to easily identify a direction in which the heat sink 600 is coupled to the housing 100 and where the heat sink 600 is coupled to the housing 100.

The base 610 may include the hole 613 through which the screw passes. The screw is inserted into the hole 613, and then is coupled to the fastener 130 of the housing 100. The number of the holes 613 may correspond to the number of the fasteners 130.

The base 610 may include the support 615. The support 615 supports the circuit board 510 of the driving part 500. The support 615 may project from the base 610 toward the projection 630. The support 615 may have a height the same as the thickness of the thermal pad 700. The support 615 may cause the circuit board 510 of the driving part 500 to be fixed in parallel with the first surface of the base 610.

The base 610 may include a top surface on which the driving part 500 is disposed and a bottom surface exposed to the outside. Here, the bottom surface is flat. Due to the flat bottom surface, heat can be effectively radiated.

The projection 630 may include one side on which the substrate 410 of the light source 400 is disposed. When the one side of the projection 630 is disposed in a particular position within the lighting device according to the embodiment, a predetermined effect can be obtained. Hereafter, this will be described in detail.

The one side of the projection 630 may be disposed between a first point and a second point. The first point may indicate a half of the overall height of the housing 100. The second point may indicate the minimum interval of 5 mm between the light emitting device 430 and the optical plate 200.

When the one side of the projection 630 is disposed between the first point and the second point, heat radiation efficiency and optical efficiency (lm/W) can be more improved and hot spot can be reduced more as compared with a case where the one side of the projection 630 is disposed outside the first and the second points. More specifically, when the one side of the projection 630 is disposed under the first point, a distance between the light emitting device 430 and the optical plate 200 becomes larger, so that the optical efficiency (lm/W) of the lighting device according to the embodiment may be degraded. When the one side of the projection 630 is disposed on the second point, in other words, on a position within the minimum interval of 5 mm between the light emitting device 430 and the optical plate 200, hot spot caused by the light emitting device 430 may be generated in the optical plate 200.

The projection 630 may include the key 631. A plurality of the keys 631 may be disposed on the top surface of the projection 630. The key 631 is inserted into the hole 415 of the substrate 410 of the light source 400. The position and direction of the substrate 410 can be recognized by the key 631.

The projection 630 may include the fastening hole 633. The fastening hole 633 may be disposed adjacent to the key 631. The fastening hole 633 is coupled to the screw inserted into the hole 415 of the substrate 410 of the light source 400.

The heat sink 600 may be formed of a metallic material or a resin material, each of which has excellent heat radiation efficiency. However, there is no limit to the material of the heat sink 600. For example, the material of the heat sink 600 may include at least one of Al, Ni, Cu, Ag, Sn and Mg.

<Reflector 300, Light Source 400 and Heat Sink 600>

Referring to FIG. 6, the light source 400 is disposed on the heat sink 600, and the reflector 300 is disposed on the light source 400. Specifically, the substrate 410 of the light source 400 is disposed on the projection 630 of the heat sink 600, and the reflecting portion 310 of the reflector 300 is disposed on the substrate 410. However, there is no limit to this. The light source 400, together with the reflector 300, may be disposed on the heat sink 600. Specifically, the substrate 410 of the light source 400 is disposed on the top surface of the projection 630 of the heat sink 600, and the reflecting portion 310 of the reflector 300 surrounds the substrate 410 and is disposed on the top surface of the projection 630.

The inner receiving space is limited by the housing 100, the optical plate 200 and the base 610 of the heat sink 600. Accordingly, like a conventional lighting device, when the light source is integrally formed with the driving part, that is, when the substrate of the light source is integrally formed with the circuit board of the driving part, the substrate is located in the lower portion of the housing. Accordingly, the size and height of the reflector of the conventional lighting device are increased. Then, a distance between the substrate and the optical plate becomes larger, so that the efficiency of light emitted from the optical plate is degraded.

Contrarily, in the lighting device according to the embodiment, the light source 400 is separated from the driving part 500, and the height of the projection 630 of the heat sink 600 may be changed according to a designer's intention. Therefore, the light source 400 can be placed closer to the optical plate 200. Also, the reflective surface 310*a* of the reflector 300 can be comprised of one surface in lieu of several surfaces. Since the angle "a" formed by the substrate 410 and the reflective surface 310*a* of the reflector 300 may be increased, the efficiency of light emitted from the optical plate 200 is increased.

<Thermal Pad 700>

The lighting device according to the embodiment may further include the thermal pad 700.

The thermal pad 700 may be disposed between the heat sink 600 and the driving part 500. Specifically, the thermal pad 700 may be disposed between the base 610 of the heat sink 600 and the circuit board 510 of the driving part 500. Here, the thermal pad 700 may be disposed on a portion of the base 610.

The thermal pad 700 has a predetermined depth and is able to rapidly transfer the heat from the circuit board 510 of the driving part 500 to the base 610.

The thermal pad 700 may be disposed only on a particular position of the circuit board 510. The thermal pad 700 may be disposed under a part, e.g., a transformer, which particularly generates a lot of heat among numbers of the parts 520 disposed on the circuit board 510.

The thermal pad 700 may have a thickness the same as the height of the support 615 of the heat sink 600. Thanks to the thermal pad 700 and the support 615, the circuit board 510 of the driving part 500 can be disposed in parallel with the top surface of the base 610.

The thermal pad 700 may include a recess 715. The fastener 130 of the housing 100 may be disposed in the recess 715. When the fastener 130 is inserted into the recess 715, it is possible to prevent the thermal pad 700 from moving and to identify the arrangement direction or position of the thermal pad 700.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a heat sink that comprises a base and a projection extending from the base and having one side;

a light source that comprises a substrate disposed on the one side of the projection and a light emitting device disposed on the substrate;

an optical plate disposed on the light emitting device;

a driving part that is disposed on the base and is electrically connected to the light source; and a housing that receives the heat sink, the light source, the optical plate and the driving part, wherein the one side of the projection is disposed between a first point and a second point, wherein the first point indicates a half of an overall height of the housing, wherein the second point indicates a minimum interval of 5 mm between the light emitting device and the optical plate, and wherein the housing has a cylindrical shape, wherein the housing comprises an upper part and a lower part, and wherein an outer diameter of the upper part increases from the lower part to the upper part.

2. The lighting device of claim 1, further comprising a reflector disposed between the light source and the optical plate, wherein the reflector comprises:

a reflecting portion that is disposed on the substrate of the light source and forms a predetermined angle with a top surface of the substrate of the light source; and a guide that is disposed on the reflecting portion and guides the optical plate.

3. The lighting device of claim 1, wherein the housing comprises a top opening and a bottom opening, wherein the optical plate is disposed in the top opening, and wherein the base of the heat sink is disposed in the bottom opening.

4. The lighting device of claim 1, wherein the projection of the heat sink is disposed in the center of the base of the heat sink, and wherein the driving part comprises a circuit board including an opening into which the projection of the heat sink is inserted and comprises parts disposed on the circuit board.

5. The lighting device of claim 4, further comprising a thermal pad disposed between the circuit board of the driving part and the base of the heat sink.

6. The lighting device of claim 4, wherein the base of the heat sink comprises a fastening hole, wherein the housing comprises a fastener corresponding to the fastening hole of the heat sink, and wherein the fastener of the housing is disposed on the circuit board of the driving part and limits movement of the circuit board.

7. The lighting device of claim 6, wherein the circuit board of the driving part comprises a recess into which the fastener of the housing is inserted, and wherein the recess indicates a direction in which the circuit board is coupled to the housing and where the circuit board is coupled to the housing.

8. The lighting device of claim 6, further comprising a thermal pad disposed between the circuit board of the driving part and the heat sink, wherein the thermal pad comprises a recess into which the fastener of the housing is inserted, and wherein the recess indicates a direction in which the circuit board is coupled to the housing and wherein the circuit board is coupled to the housing.

9. The lighting device of claim 1, wherein the one side of the projection comprises a projecting key, and wherein the substrate of the light source comprises a hole into which the key is inserted.

10. The lighting device of claim 9, wherein the one side of the projection is coupled to a screw and comprises a fastening hole disposed adjacent to the key, and wherein both the screw and the key are coupled to the hole of the substrate of the light source.

11. A lighting device comprising:

a heat sink that comprises a base and a projection, wherein the base comprises a first surface, and wherein the projection extends from the first surface of the base and comprises a second surface;

a light source that comprises a substrate disposed on the second surface of the projection and a light emitting device disposed on the substrate;

a driving part that is disposed on the first surface of the base and is electrically connected to the light source; and a housing that receives the heat sink, the light source and the driving part, wherein a second straight line passing through a center of the second surface of the projection is ⅓ to ½ as much as a first straight line passing through a center of the first surface of the base, wherein the driving part comprises a circuit board and parts disposed on the circuit board, wherein the base of the heat sink comprises a fastening hole, wherein the housing comprises a fastener corresponding to the fastening hole of the heat sink, and wherein the fastener of the housing is disposed on the circuit board of the driving part and limits movement of the circuit board.

12. The lighting device of claim 11, wherein the projection of the heat sink is disposed in a center of the base of the heat sink, and wherein the circuit board includes an opening into which the projection of the heat sink is inserted.

13. The lighting device of claim 11, further comprising a thermal pad disposed between the circuit board of the driving part and the heat sink, wherein the thermal pad comprises a recess into which the fastener of the housing is inserted, and wherein the recess indicates a direction in which the circuit board is coupled to the housing and wherein the circuit board is coupled to the housing.

14. The lighting device of claim 11, wherein the one surface of the projection comprises a projecting key, and wherein the substrate of the light source comprises a hole into which the key is inserted.

15. A lighting device comprising:

a heat sink that comprises a base and a projection extending from the base and having one side;

a light source that comprises a substrate disposed on the one side of the projection and a light emitting device disposed on the substrate; and a driving part that is disposed on the base and is electrically connected to the light source, wherein the one side of the projection comprises a projecting key, wherein the substrate of the light source comprises a hole into which the key is inserted, and wherein the one side of the projection is coupled to a screw and comprises a fastening hole disposed adjacent to the key, and wherein both the screw and the key are coupled to the hole of the substrate of the light source.

16. The lighting device of claim 15, further comprising a housing that receives the heat sink, the light source and the driving part, wherein the base of the heat sink comprises a fastening hole, wherein the housing comprises a fastener corresponding to the fastening hole of the heat sink, wherein the driving part comprises a circuit board having an opening into which the projection of the heat sink is inserted and comprises parts disposed on the circuit board, and wherein the fastener of the housing is disposed on the circuit board of the driving part and limits movement of the circuit board.

17. The lighting device of claim 16, wherein the circuit board of the driving part comprises a recess into which the fastener of the housing is inserted, wherein the recess indicates a direction in which the circuit board is coupled to the housing and wherein the circuit board is coupled to the housing.

18. The lighting device of claim 16, further comprising a thermal pad disposed between the circuit board of the driving part and the heat sink, wherein the thermal pad comprises a recess into which the fastener of the housing is inserted, and wherein the recess indicates a direction in which the circuit board is coupled to the housing and wherein the circuit board is coupled to the housing.

19. The lighting device of claim 1, wherein a thickness of the upper part is greater than a thickness of the lower part.

* * * * *